US007439722B2

(12) United States Patent
Poulet et al.

(10) Patent No.: US 7,439,722 B2
(45) Date of Patent: Oct. 21, 2008

(54) METHOD AND DEVICE FOR GRAPHICALLY ILLUSTRATING THE FILLING OF A CIGARETTE

(75) Inventors: Jean Remi Poulet, Fleury les Aubrais (FR); Georges Cholet, Ormes (FR)

(73) Assignee: Societe Nationale d'Exploitation Industrielle des Tabacs et Allumettes (SEITA), Paris (FR)

( * ) Notice: Subject to any disclaimer, the term of this patent is extended or adjusted under 35 U.S.C. 154(b) by 331 days.

(21) Appl. No.: 11/293,365

(22) Filed: Dec. 5, 2005

(65) Prior Publication Data

US 2006/0125468 A1 Jun. 15, 2006

(30) Foreign Application Priority Data

Dec. 10, 2004 (FR) ..... 04 13168

(51) Int. Cl.
*G01R 23/16* (2006.01)

(52) U.S. Cl. ..... 324/76.12; 324/76.11; 324/643

(58) Field of Classification Search ..... 324/76.11, 324/76.12, 643; 131/61.1, 280
See application file for complete search history.

(56) References Cited

U.S. PATENT DOCUMENTS 4,805,641 A 2/1989 Radzio et al.
4,986,285 A 1/1991 Radzio et al.
5,010,904 A 4/1991 Lassiter
5,347,853 A 9/1994 Hoppe et al.
5,510,616 A * 4/1996 Seymour et al. ..... 250/308
6,163,158 A 12/2000 Moeller et al.
2001/0000946 A1 5/2001 Moeller et al.

FOREIGN PATENT DOCUMENTS

DE 41 19 821 A1 12/1992
DE 197 34 978 A1 2/1999
EP 0 434 457 A1 6/1991

* cited by examiner

*Primary Examiner*—Vincent Q Nguyen
(74) *Attorney, Agent, or Firm*—Browdy and Neimark, P.L.L.C.

(57) ABSTRACT

A method for analyzing the filling of a cigarette by using a sinusoidal mathematical model representing the density of tobacco along the longitudinal axis of the cigarette and by conducting experimental measurements of density and of moisture at a plurality of points along this longitudinal axis, calculating a regression determination coefficient from the measured values, calculating the position of the strengthened tip from the phase $\phi$ and the parameters of the model and from experimentally determined constants, calculating the shift of the strengthened tip relatively to the cut and calculating the strengthening index from the values of these constants.

10 Claims, 2 Drawing Sheets

METHOD AND DEVICE FOR GRAPHICALLY ILLUSTRATING THE FILLING OF A CIGARETTE

BACKGROUND OF THE INVENTION

1. Field of the Invention

The present invention relates to a method and a device for graphically illustrating the profile for filling a cigarette notably in order to control the strengthening amplitude and the position of strengthened tips relatively to the cut of the stem.

2. Description of the Prior Art

Generally, it is known that cigarette manufacturers have been lead to reduce tobacco density in cigarettes for economical reasons.

The two following questions were then raised:

how to retain proper resistance of the tips, how to retain proper assembling quality.

The retained solution for solving both of these problems was to retain the initial density for the tips (or even strengthen it) and to only reduce the density in the middle of the tobacco section.

It then became necessary to control the strengthening amplitude and the position of the strengthened tips as compared to the cut.

The applicant therefore developed a device for analyzing the filling of cigarettes called ARC, meeting this need.

This device was designed in order to axially displace the cigarettes in a tubular component comprising two diametrically opposite coaxial ports, i.e.:

- a first port for emitting radioactive radiation (β radiation) from a radioactive strontium 90 source, and
- a port for receiving this radiation located facing an ionization chamber connected to a measuring circuit with which the attenuation of the β radiation may be measured after its passing through the tobacco, it being understood that this attenuation is a function of the density of the material crossed.

In this device, a stepper motor drive system causes displacement of the cigarette inside the tubular component. The measuring circuit is then driven in order to record at each step the density of the material crossed by the radiation in the axis of both ports.

This technology was abandoned subsequently because of constraining regulations relating to the handling of radioactive elements.

The applicant then developed another solution consisting of having the cigarette passed through an hyper frequency tuned cavity having a relatively low active thickness, for example of 3 mm. By combining the shift of the tuning frequency and the attenuation of the radiated signal when the cigarette passes through the cavity, it is possible to plot the density profile of the tobacco section of the cigarette.

In one case as in the other, the measured density values are used for obtaining the plot of the density profile of the cigarette.

Nevertheless, the visual interpretation of the plot of the density profile in order to determine with sufficient accuracy the position of the strengthened tips relatively to the cut of the stem and the strengthening amplitude is found to be difficult and uncertain as it depends on the operator.

OBJECT OF THE INVENTION

More particularly, the object of the invention therefore is to determine these parameters automatically.

SUMMARY OF THE INVENTION

For this purpose it generally proposes a method based on the observation that the aspect of the density profile of the tobacco section of a cigarette, both with two symmetrical strengthened tips and a single strengthened tip or with two asymmetrical strengthened tips, is periodic and may be modeled as a sinusoidal form.

Considering this observation, the method according to the invention comprises the following operating phases:

- elaborating a sinusoidal mathematical model representing density y versus axial position x, this model taking parameters into account such as the length of the tobacco section L, the total length of the cigarette LT, the length of the filter LF and using at least three constants A0, A1 and ϕ to be determined experimentally,
- conducting experimental measurements in order to determine the average density D and the average moisture H in a plurality of points along the longitudinal axis of the cigarette,
- calculating a regression determination coefficient $R^2$ from the measured values,
- calculating the position P of the strengthened tip from the phase ϕ and the aforesaid parameters,
- calculating the shift of the strengthened tip relatively to the cut from the position P calculated earlier,
- calculating the strengthening index from the value of the aforesaid coefficient A1.

BRIEF DESCRIPTION OF THE DRAWINGS

Embodiments of the invention will be described hereafter, as non-limiting examples, with reference to the appended drawings wherein.

DESCRIPTION OF THE PREFERED EMBODIMENTS

Figure 1:
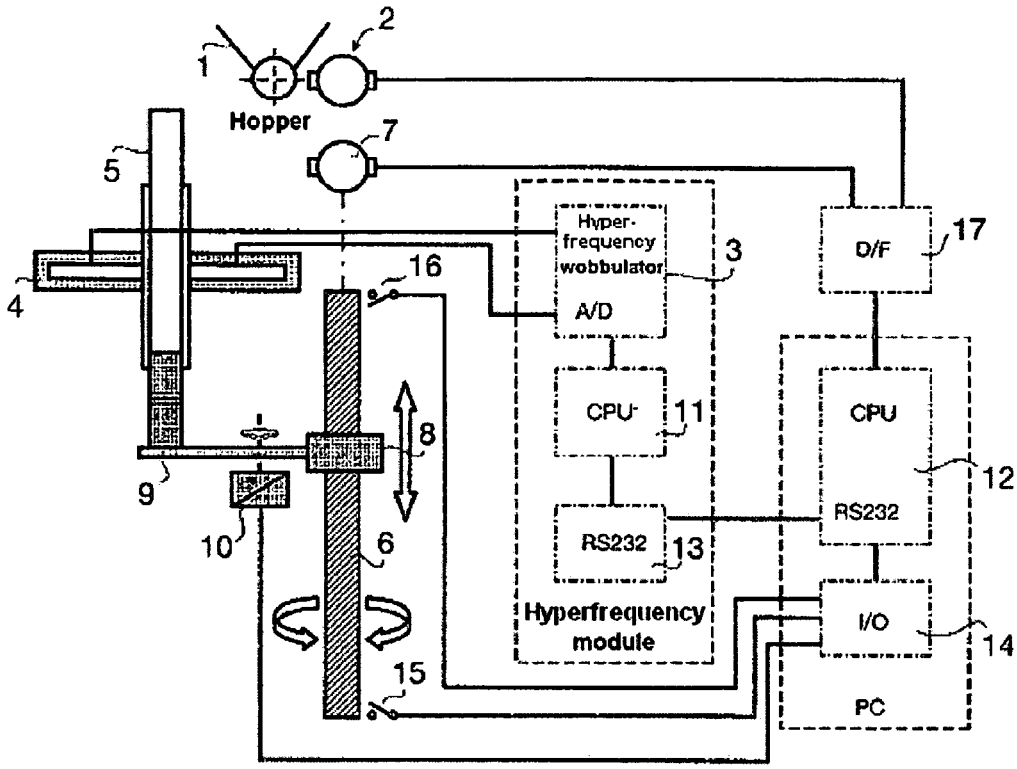
FIG. 1 is a schematic illustration of a device for applying the method according to the invention.

In the example illustrated in FIG. 1, the device for graphically illustrating the filling profile and for determining the strengthening amplitude and the position of the strengthened tips relatively to the cut of the stem consists of the main components hereafter:

- A hopper 1 associated with a distributor 2 which delivers cigarettes one by one.
- An hyper frequency module comprising an electronic rack 3 (wobbulator) and a cavity 4 crossed by a tube for guiding the cigarettes, which measures the point density and the moisture of the cigarettes 5 passing through cavity 4.
- Constant rate driving means for cigarettes during their passing in the cavity, these driving means comprising in this example a worm screw 6 driven by an electric motor 7 and a sprocket wheel 8 driven into translation by the screw 6, this sprocket wheel 8 bearing a pivoting support arm 9 the pivoting of which is provided by an electromechanical actuator 10.

A microcontroller 11 used for providing control of the hyper frequency module 3 and for preprocessing of information delivered by this module 3.

A processor 12 connected to the former via a link 13 for example of the RS 232 type, to an input/output interface 14 connected to the actuator 10 as well as two end-of-travel contacts 15, 16, positioned at the ends of the travel of the sprocket wheel 8, and to a power circuit 17 connected to the motor of the distributor 2 associated with the hopper 1. This processor 12 is associated with conventional interfaces (display, printing, input, . . . ) which have not been illustrated. It provides management of the device and carries out processing of the information relative to the performed measurements, delivered by the microcontroller 11.

As an example, the instantaneous density and moisture values will be transferred to the processor 12 by the microcontroller 11 every 50 ms, which corresponds to a 1 mm displacement of the cigarette and to a velocity of 20 mm/s.

Figure 2:
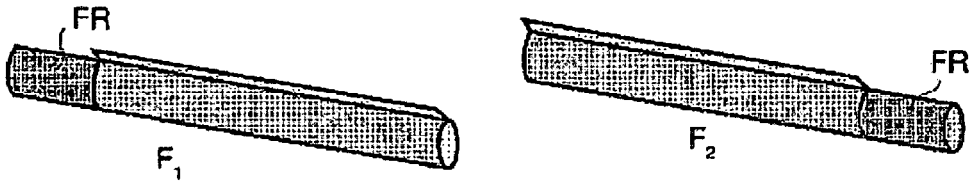
FIG. 2 illustrates two perspective views showing two cigarettes presented along the preparation direction.

Before carrying out a series of measurements, the cigarettes 5 should be sorted into two families illustrated in FIG. 2, i.e.:

a first family $F_1$, the filter of which is positioned in front of the tobacco section relatively to the preparing direction, a second family $F_2$, the filter of which is positioned behind the tobacco section relatively to the preparation direction.

After having measured both families, first the filter, the average results of family $F_2$ are reversed (re-establishment of the preparation direction) in order to be processed with family $F_1$.

In the case of cigarettes with two symmetrical strengthened tips $BS_1$, $BS_2$, the density profile is periodical and of a period equal to the length of the tobacco section.

Figure 3:
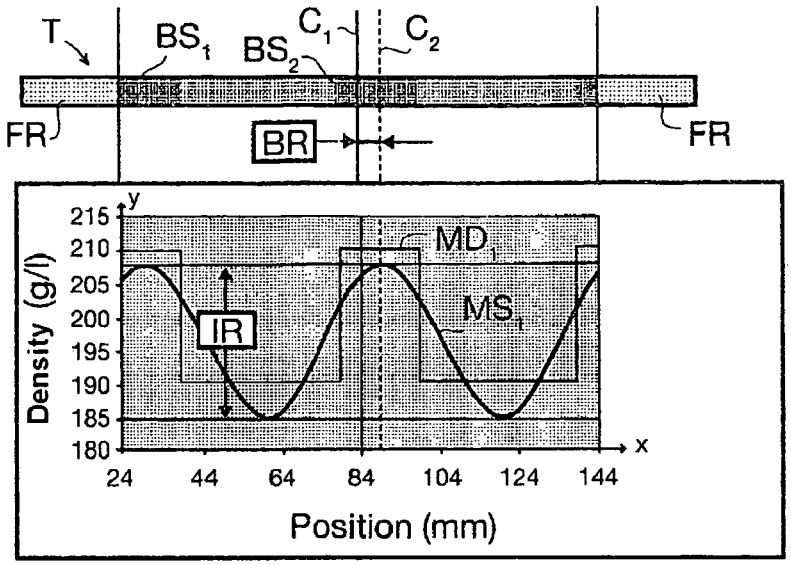
FIG. 3 is a density/position diagram presented in relation with a stem comprising two cigarettes with two symmetrical strengthened tips.

This periodicity appears in FIG. 3 where a diagram of density in g/l is illustrated versus the position (mm) in relation with a stem comprising two cigarettes, wherein the filters FR are located opposite each other; the actual real cut $C_1$ (position of the strengthened tip BR) as well as the theoretical cut $C_2$ which extend in the middle of areas more dense in scaferlati are indicated in full lines or dashed lines, respectively.

This diagram comprises the plot of a $MS_1$ density sinusoidal model and the curve connecting the measured density $MD_1$ values. A periodic density profile is shown with a period equal to the length of the tobacco section of a cigarette and it fits the following equation:

$$Y=A_0+A_1\times\cos\,[2\times\pi\times(x-\phi)/L]$$

with y=density x=position

L=tobacco length, i.e., total length LT−filter length LF $A_0$, $A_1$, $\phi$=constants With a sinusoidal regression on the measured points (determination coefficient $R^2$), it is possible to automatically determine the strengthening amplitude and the shift of the strengthened tip relatively to the cut $C_2$ (the actual cut $C_1$ is generally shifted relatively to the theoretical cut $C_2$ which is basically located in the middle of a strengthening area corresponding to the stem T).

The determined parameters then are:

The average moisture H

The average density D

The regression determination coefficient $R^2$

The position P of the strengthened tip may be obtained for example by the following operating sequence:

$$\text{If } A_1<0 \rightarrow \phi=\phi+0.5\times L$$

$$P=\text{modulo}\ (\phi/L)$$

$$\text{If } P<LT-L/2 \text{ then } P=P+L\times[\text{int}((LT-L/2-P)/L)+1]$$

The shift of the strengthened tip BR is for example obtained by a formula of the type $$BR=P-LT$$

The strengthening index IR as for it, is obtained by a relation of the type $$IR=2\times|A1|$$

It is found that two other types of cigarettes are also proposed on the market, i.e.: cigarettes with a single strengthened tip and cigarettes with two symmetrical strengthened tips.

In the first case, the cigarette comprises a single strengthened tip BD located on the distal end of the cigarette.

In order to determine the density profile and the position of this strengthened tip relatively to the cut, the invention is also based on the observation that this profile is always periodic and that, in this case, the period is equal to double the length of the tobacco section.

Figure 4:
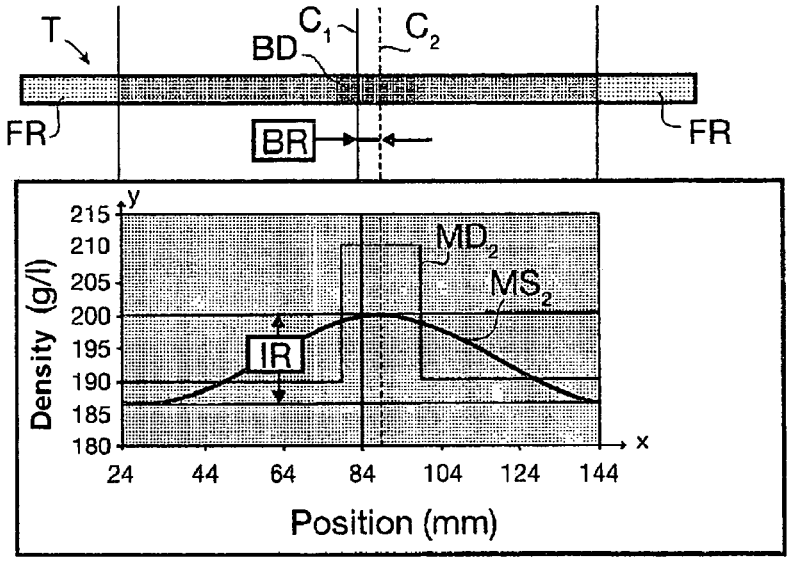
FIG. 4 is an illustration similar to that of FIG. 3 for cigarettes with a single strengthened tip.

This periodicity appears in FIG. 4 wherein a g/l density diagram is illustrated similarly to FIG. 3, versus the position in mm in relation with a stem T comprising two cigarettes positioned end-to-end, the filters FR being positioned opposite each other.

Here also, the actual performed cut $C_1$ as well as the theoretical cut $C_2$ are shown in full lines and in dashed lines.

This diagram comprises the plot of a density sinusoidal model $MS_2$ with a period equal to twice the length of the tobacco section of a cigarette and the curve $MD_2$ connecting the measured density values.

The sinusoidal model $MS_2$ used fits the following equation:

$$y=A_0+A_1\times\cos\,[2\times\pi\times(x-\phi)/(2\times L)]$$

with y=density x=position

L=length of the tobacco section=total length of the cigarette LT−filter length LF $\phi$=phase here also, a sinusoidal regression on the measured points (determination coefficient $R^2$) enables the strengthening amplitude and the shift of the strengthened tip relatively to the cut to be determined automatically.

The determined parameters then are:

The average moisture H

The average density D

The regression determination coefficient $R^2$

The position P of the straightened tip is then obtained by the following operating sequence:

$$\text{If } A_1<0 \text{ then } \phi=\phi+L$$

$$P=\text{modulo}\ [\phi/(2\times L)]$$

$$\text{If } P<LT-L \text{ then } P=P+2\times L\times[\text{int}((LT-L-P)/(2\times L))+1]$$

The shift of the strengthened tip BR is obtained by a formula of the type $$BR=P-LT$$

The strengthening index is obtained by a formula of type $$IR=2\times|A1|$$

It is found that assembling cigarettes with a strengthened tip BD is delicate because of a certain "softness" of the tobacco section on the filter side.

This is the reason why a conformation of cigarettes, intermediate between the cigarette with two symmetrical strengthened tips as the one illustrated in FIG. 3 and the cigarette with one strengthened tip illustrated in FIG. 4 was proposed, by creating cigarettes with two asymmetrical strengthened tips $BA_1$, $BA_2$ comprising significant strengthening on the distal side and average strengthening on the filter FR side.

Here also, the invention is based on the observation that the density profile is periodic and with a periodicity equal to twice the length of the tobacco.

It proposes to automatically determine the strengthening amplitudes and the shift of the strengthened tip relatively to the cut by means of an even sinusoidal regression of the second order, with a period equal to twice the length of the tobacco.

The sinusoidal model used fits the following equation:

$$y=A_0+A_1\times\cos[2\times\pi\times(x-\phi)/(2\times L)]+A_2\times\cos[4\times\pi\times(x-\phi)/(2\times L)]$$

with y=density x=position

L=length of the tobacco section

The determined parameters also are:

The average moisture H

The average density D

The regression determination coefficient $R^2$

The position P of the strengthened tips is obtained by the following operating sequence:

$$\text{If } A_1<0\ \phi=\phi+L$$

the expression of the maximum density value $y_F$ of the high-strength tip is $$y_F=A_0+A_2-A_1$$

The expression of the maximum density value $y_f$ of the low-strength tip is $$y_f=A_0+A_1+A_2$$

if $A_1>0$ one has $$Y_F=A_0+A_1+A_2 \text{ (maximum density of the high strength tip)}$$

$$y_f=A_0+A_2-A_1 \text{ (maximum density of the low strength tip)}$$

The position P of the strengthened tips is obtained by the following operating sequence:

$$P=\text{modulo}\ [\phi/(2\times L)]$$

$$\text{If } P<LT-L \text{ then } P=P+2\times Lx[\text{int}((LT-L-P)/(2\times L))+1]$$

The shift of the strengthened tips is obtained by the relationship:

$$BR=P-LT$$

$$\text{Minimum, min}=y(x) \text{ for } x=\phi+L/\text{pi}\times\text{Arccos}(-A_1/4/A_2)$$

$$\text{High strengthening index } IR_F=y_F-\text{min}$$

$$\text{Low strengthening index } IR_f=y_f-\text{min}$$

Figure 5:
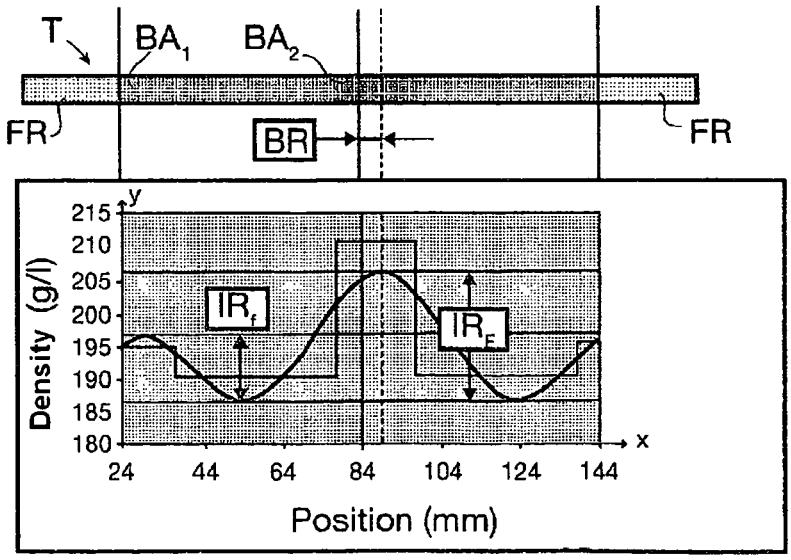
FIG. 5 is an illustration similar to those of FIGS. 3 and 4 for cigarettes with two asymmetrical strengthened tips.

With the illustrated embodiments in FIGS. 3 to 5, excellent results may be obtained within the range of measurements performed by the device illustrated in FIG. 1.

Nevertheless, the invention is not limited to this solution, it being understood that density measurements may be performed by other techniques such as, for example, the ionization radiation technique (the β ray technique having been set aside exclusively for regulatory matters).

The invention claimed is:

1. A method for analyzing filling density of a cigarette with tobacco, said cigarette having a stem provided with a cut performed during manufacturing of said cigarette, a strengthened tip ,a filter, and parameters comprising at least a length of tobacco, a section L of the cigarette, a total length of the cigarette LT, a length of said filter LF, said method comprising the steps of:

determining a filling profile of said cigarette; and calculating from said profile and from experimental measurements the position of said strengthened tip relatively to said cut and of the strength of said strengthened tip, said method comprising the following operating phases:

elaborating a sinusoidal mathematical model representing said density y along the longitudinal axis of said cigarette, this model taking said parameters into account and at least two constants A0, A1 and a phase ϕ which are determined experimentally, achieving experimental measurements so as to determine an average density D of the tobacco and an average moisture H of said tobacco at a plurality of points along the longitudinal axis of the cigarette, calculating a regression determination coefficient $R^2$ from the measured values, calculating a position P of the strengthened tip from the phase ϕ and the aforesaid parameters, calculating a shift of the strengthened tip relatively to the cut from the position P calculated earlier, calculating a strengthening index from the value of said constants.

2. The method according to claim 1, wherein, in the case of cigarettes with two symmetrical strengthened tips, the model of the sinusoidal plot is periodic, with a period equal to the length of tobacco section and fits the following equation:

$$Y=A_0+A_1\times\cos[2\times\pi\times(x-\phi)/LJ$$

with y=density x=position

L=tobacco length, i.e., total length LT—filter length LF $A_0$, $A_1$, (ϕ=constants.

3. The method according to claim 2, wherein:

the position P of the strengthened tip obtained by the following operating sequence:

$$\text{if } A_1<0\rightarrow\phi+0.5\times L$$

$$P=\text{modulo}\ (\phi/L)$$

$$\text{if } P<LT-L\ T/2 \text{ then } P=P+L\times[\text{int}((LT-L/2-P)/L)+1]$$

the shift of the strengthened tip BR is obtained by a formula of the type $$BR=P-LT$$

the strengthening index IR, is obtained by a relationship of the type $$IR=2\times|A1|.$$

4. The method according to claim 1, wherein, in the case when the cigarette comprises a single strengthened tip BD located on the distal end of the cigarette, the sinusoidal model $MS_2$ used fits the following equation:

$$y=A_0+A_1\times\cos[2\times\pi\times(x-\phi)/(2\times L)]$$

with y=density x=position

L=length of the tobacco section=total length of cigarette−filter length LT

ϕ=phase.

5. The method according to claim 4, wherein the position P of the strengthened tip is obtained by the following operating sequence:

$$\text{if } A_1<0 \text{ then } \phi=\phi+L$$

$$P=\text{modulo}[\phi/(2\times L)]$$

$$\text{if } P<LT-L \text{ then } P=P+2\times L\times[\text{int}((LT-L-P)/(2\times L))+1]$$

the shift of the strengthened tip BR is obtained by a formula of the type $$BR=P-LT$$

the strengthening index is obtained by a formula of the type $$IR=2\times|A|.$$

6. The method according to claim 1, wherein, in the case when the cigarette comprises significant strengthening on the distal side and medium strengthening on the filter side FR, the sinusoidal module used fits the following equation:

$$y=A_0+A_1\times\cos[2\times\pi\times(x-\phi)/(2\times L)]+A_2\times\cos[4\times\pi\times(x-\phi)/(2\times L)]$$

with y=density x=position

L=length of the tobacco section.

7. The method according to claim 6, wherein:

the position P of the strengthened tips is obtained by the following operating sequence:

$$\text{if } A_1<0\ \phi=\phi+L$$

the expression of the maximum density value $y_F$ of the high-strength tip is $$y_{F=A0}+A_2-A_1$$

the expression of the maximum density value $y_f$ of the low-strength tip is $$y_f=A_0+A_1+A_2$$

if $A_1>0$ one has $$Y_F=A_0+A_1+A_2 \text{ (maximum density of the high-strength tip)}$$

$$y_f=A_0+A_2-A_1 \text{ (maximum density of the low-strength tip)}$$

the position P of the strengthened tips is obtained by the following operating sequence:

$$P=\text{modulo}[\phi/(2\times L)]$$

$$\text{if } P<LT-L \text{ then } P=P+2\times Lx[\text{int}((LT-L-P)/(2\times L))+1]$$

the shift of the strengthened tips is obtained by the relationship $$BR=P-LT$$

$$\text{Minimum min}=y(x) \text{ for } x=\phi+L/pi\times\text{Arccos}(-A_1/4/A_2)$$

$$\text{Low strengthening index } IR_F=y_F-\text{min}$$

$$\text{Low strengthening index } IR_f=y_f-\text{min}.$$

8. A device for analyzing the filling of a cigarette with tobacco said cigarette having a stem provided with a cut performed during manufacturing of said cigarette, a strengthened tip, a filter, and parameters comprising at least a length of tobacco, a section L of the cigarette, a total length of the cigarette LT, a length of said filter LF said device comprising:

means for determining a filling profile of said cigarette; and means for calculating from said profile and from experimental measurements the position of said strengthened tip relatively to said cut and of the strength of said strengthened tip, said device comprising:

means for elaborating a sinusoidal mathematical model representing density y along the longitudinal axis of said cigarette, this model taking said parameters into account and at least two constants A0, A1 and a phase ϕ which are determined experimentally, measuring means for achieving experimental measurements and for determining an average density D and an average moisture H at a plurality of points along the longitudinal axis of the cigarette, said measuring means comprising a hyper frequency module comprising an electronic rack and a cavity crossed by a tube for guiding the cigarettes, which measures the point density and the moisture of the cigarettes passing through the cavity, means for calculating a regression determination coefficient $R^2$ from the measured values, means for calculating the position P of the strengthened tip from the phase ϕ and the aforesaid parameters, means for calculating a shift of the strengthened tip relatively to the cut from the position P calculated earlier, means for calculating a strengthening index from the value of said constants, said device further comprising a hopper associated with a distributor which delivers cigarettes one by one, to the hyper frequency module and constant rate driving means provided for the cigarettes passing the cavity.

9. The device according to claim 8, wherein the aforesaid driving means comprise a worm screw driven by an electric motor and a sprocket wheel driven into translation by the screw, this sprocket wheel bearing a pivoting supporting arm, the pivoting of which is provided by an electromechanical actuator.

10. The device according to claim 9, comprising a microcontroller used for providing the control of the hyper frequency module and pre-processing of the information delivered by this module and a processor connected to the former via a link for example of the RS 232 type, to an input/output interface connected to the actuator as well as to end-of-travel contacts positioned at the ends of the travel of the sprocket wheel, and to a power circuit connected to the motor of the distributor associated with the hopper.

* * * * *